US006039540A

United States Patent [19]

Wu

[11] Patent Number: 6,039,540

[45] Date of Patent: Mar. 21, 2000

[54] FAN BLADE ASSEMBLY OF A CEILING FAN

[76] Inventor: San-Chi Wu, No. 69, Sung-Chu Rd., Pei-Tun Dist., Taichung, Taiwan

[21] Appl. No.: 09/176,727

[22] Filed: Oct. 21, 1998

[51] Int. Cl.[7] ..... B63H 1/20

[52] U.S. Cl. ..... 416/210 R; 416/207; 416/214 R; 416/244 R

[58] Field of Search ..... 416/5, 204 R, 416/208, 207, 210 R, 214 R, 244 R

[56] References Cited

U.S. PATENT DOCUMENTS

| | | | |
|---|---|---|---|
| 5,722,814 | 3/1998 | Yu | 416/204 R |
| 5,944,486 | 8/1999 | Hodgkins, Jr. | 416/210 R |
| 5,951,197 | 9/1999 | Wu | 403/315 |

*Primary Examiner*—Edward K. Look
*Assistant Examiner*—Ninh Nguyen
*Attorney, Agent, or Firm*—Ladas & Parry

[57] ABSTRACT

A fan blade assembly includes a mounting arm with a mounting end formed with a plurality of engaging posts. A blade member has a plurality of mounting holes, each having a larger bore portion and a smaller notch portion divided by a constricted portion. A plurality of elastomeric coupling members are sleeved securely on the engaging posts, and have shanks, and radial outward peripheral flanges. Each coupling member is fitted snugly in the notch portion by passing the shank thereinto after the peripheral flange has been brought to pass through the bore portion to rest on one side of the blade member. A cap member has a plurality of engaging plugs. Each engaging plug is inserted into and is fitted snugly in the bore portion of the respective mounting hole in such a manner that a guiding portion thereof will gradually be brought to abut against the constricted portion.

3 Claims, 9 Drawing Sheets

FAN BLADE ASSEMBLY OF A CEILING FAN

BACKGROUND OF THE INVENTION

1. Field of the Invention

This invention relates to a fan blade assembly of a ceiling fan for mounting on a rotor of a ceiling fan, more particularly to a fan blade assembly which can retain a blade member on a mounting arm effectively and firmly.

2. Description of the Related Art

Referring to FIGS. 1 and 2, a conventional fan blade assembly is shown to include a mounting arm 10 with one end 11 secured on a rotor (not shown) and the other end formed as a plate-like blade mounting end 13 which has a plurality of through holes 133 and a plurality of engaging posts 131 extending downwardly from the blade mounting end 13 adjacent to the through holes 133. A blade member 20 is formed with a plurality of mounting holes 21, each confined by an inner peripheral wall with a constricted portion to divide the mounting hole 21 into a notch portion 211 and a bore portion 212. As such, each engaging post 131 can be pressed into the bore portion 212 of the respective mounting hole 21, and can then be moved into the notch portion 211 via the constricted portion such that a retaining portion 132 thereof rests on a bottom side of the blade member 20. A cap member 30 has a plurality of resilient engaging plugs 31 with retaining portions 312. Each engaging plug 31 is inserted into and is fitted snugly in the bore portion 212 of the respective mounting hole 21 such that the retaining portion 312 passes through the through hole 133 for retention on the mounting end 13. Thus, the blade member 20 can be mounted on the mounting arm 10.

Since the mounting arm 10 and the cap member 30 are made of metal material and are not produced with high precision, it is difficult to assemble the engaging plugs 31 into the mounting holes 21 and the through holes 133. In addition, a clearance will be caused in each mounting hole 21 between the engaging post 131 and the respective engaging plug 31, thereby resulting in unsteady engagement of the blade member 20 on the mounting arm 10.

SUMMARY OF THE INVENTION

The object of the present invention is to provide a fan blade assembly which can retain a blade member on a mounting arm effectively and firmly.

According to this invention, a fan blade assembly includes a mounting arm with a mounting end which is formed with a plurality of engaging posts. A blade member has a plurality of mounting holes, each having a larger bore portion and a smaller notch portion divided by a constricted portion. A plurality of elastomeric coupling members are sleeved securely on the engaging posts, and have shanks and radial outward peripheral flanges. Each coupling member is fitted snugly in the notch portion by passing the shank thereinto after the peripheral flange has been brought to pass through the bore portion to rest on one side of the blade member. A cap member has a plurality of engaging plugs. Each engaging plug is inserted into and is fitted snugly in the bore portion of the respective mounting hole in such a manner that a guiding portion thereof will gradually be brought to abut against the constricted portion. Preferably, each engaging plug is further split to form a resilient portion for facilitating insertion of the engaging plug into the bore portion of the respective mounting hole.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
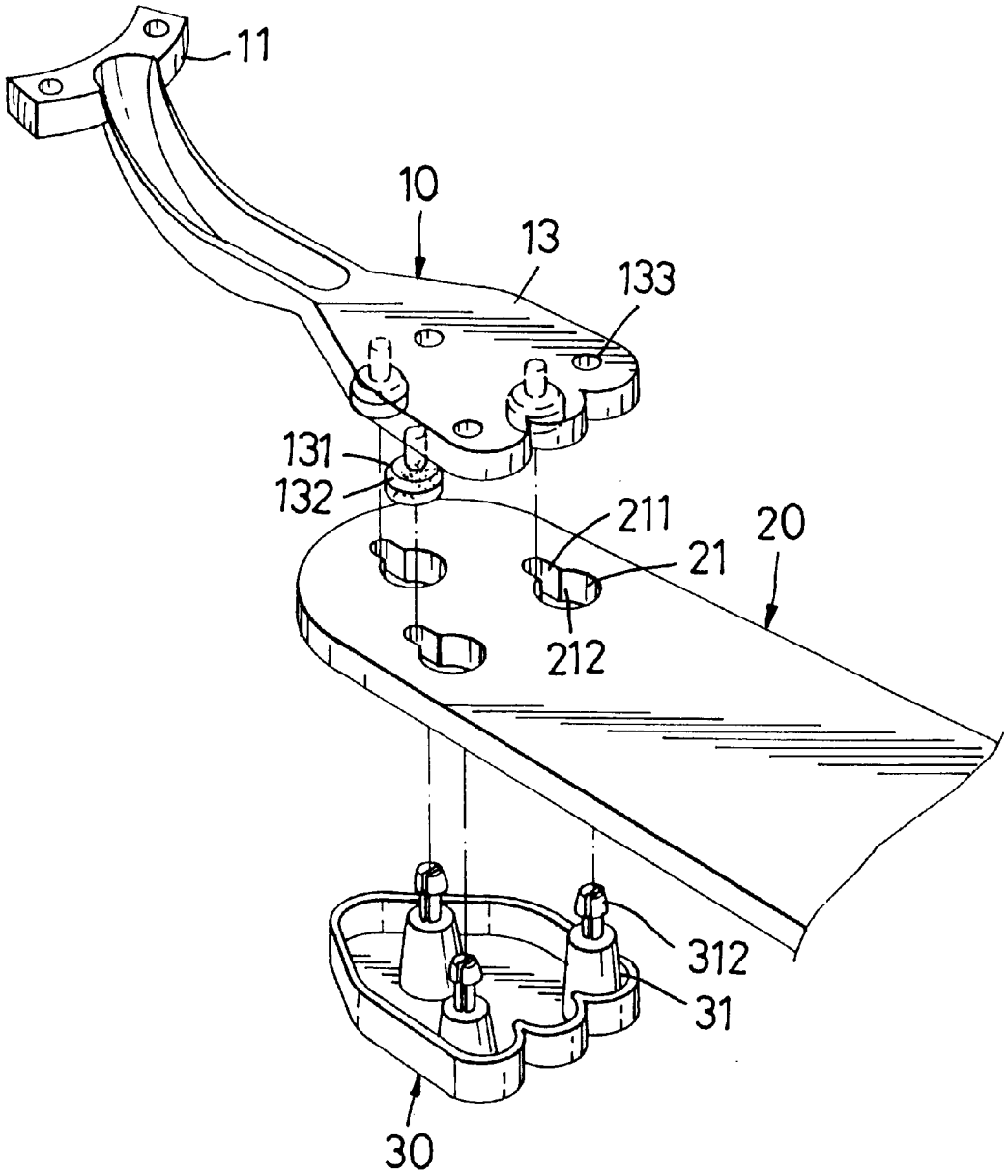
FIG.1 PRIOR ART
FIG. 1 is an exploded view showing a portion of a conventional fan blade assembly of a ceiling fan.
Figure 2:
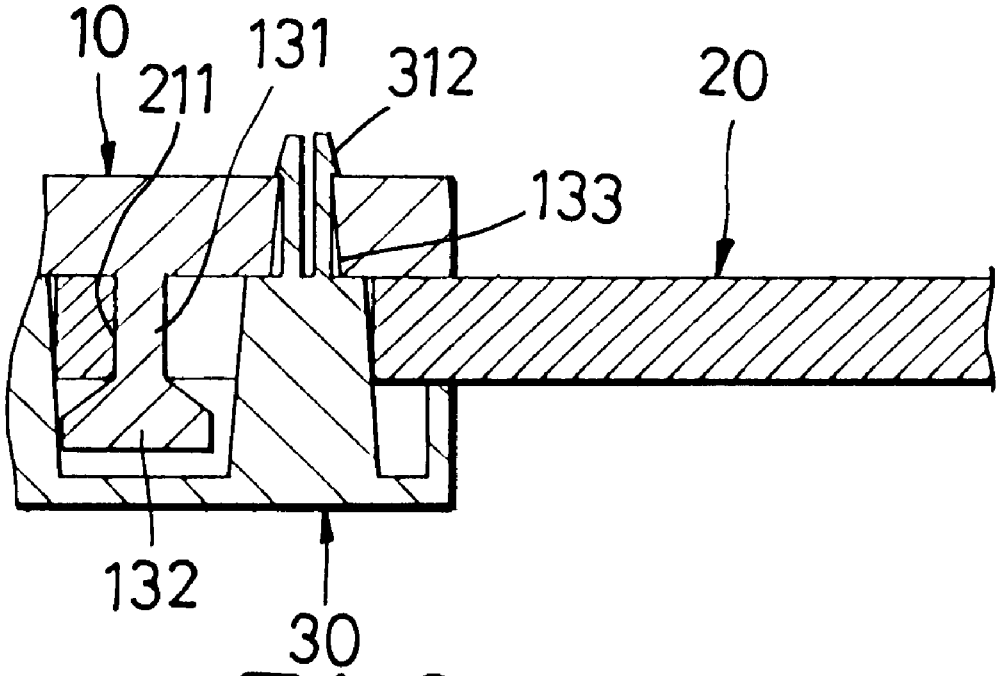
FIG.2 PRIOR ART
FIG. 2 is a sectional view of FIG. 1.

Before the present invention is described in greater detail, it should be noted that same reference numerals have been used to denote like elements throughout the specification.

Figure 3:
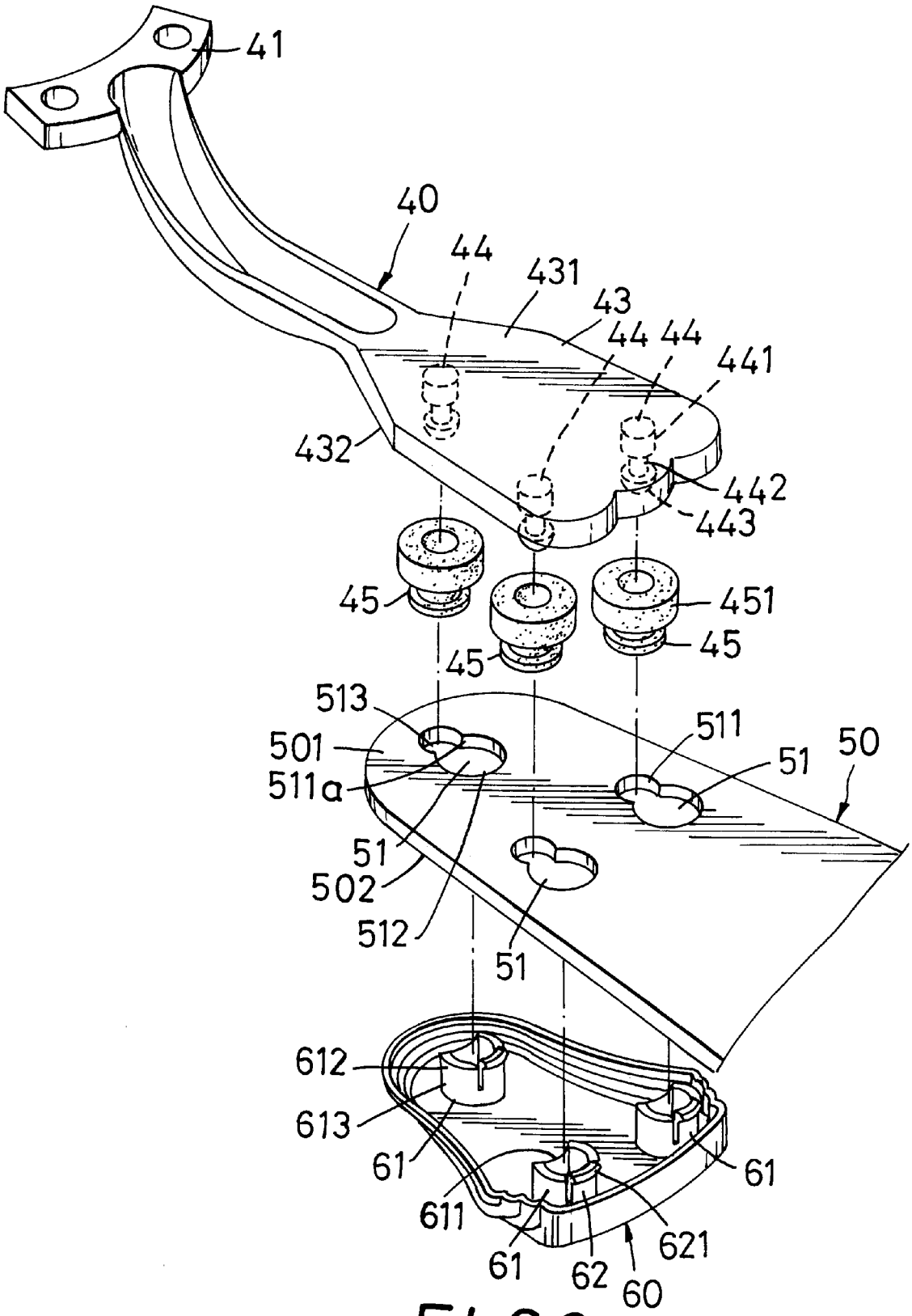
FIG. 3 is an exploded view of a first preferred embodiment of a portion of a fan blade assembly according to this invention.
Figure 4:
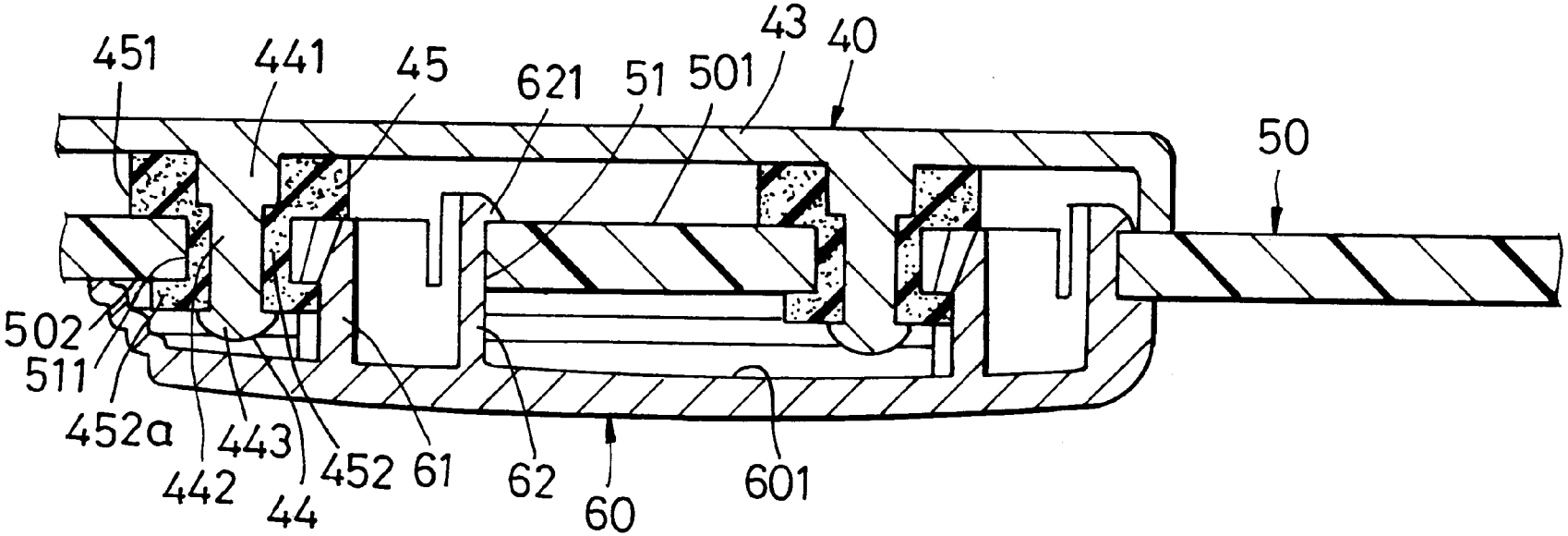
FIG. 4 is a sectional view of a portion of the fan blade assembly according to the first preferred embodiment.

Referring to FIGS. 3 and 4, the first preferred embodiment of a fan blade assembly according to the present invention is shown to comprise a mounting arm 40 which has a connecting end portion 41 adapted for coupling with a rotor of a ceiling fan (not shown), and a plate-like blade mounting end portion 43 with first and second surface walls 431,432 and a plurality of engaging posts 44 protruding downwardly from the second surface wall 432 in a longitudinal direction. Each engaging post 44 includes an upper section 441, a lower section 443, and a narrow neck section 442 formed between the upper and lower sections 441, 443.

A blade member 50 has a connecting end which has a third surface wall 501 confronting the second surface wall 432, and an opposite fourth surface wall 502. The connecting end further has a plurality of mounting holes 51, each of which is confined by an inner peripheral wall 511 with a constricted portion 511*a* to divide the mounting hole 51 into a notch portion 513 and a bore portion 512 of a dimension larger than that of the notch portion 513.

A plurality of elastomeric coupling members 45 are mounted to the connecting end of the blade member 50. Each coupling member 45 has a through hole 453 so that the corresponding one of the engaging posts 44 is inserted into and is retainingly engaged in the through hole 453 in such a manner that the lower section 443 hooks on a bottom side of the coupling member 45. In addition, each coupling member 45 includes a head 451 and a shank 452 which extends downwardly from the head 451 and which has a radial outward peripheral flange 452*a*.

A cap member 60 has an upper fifth surface wall 601 which confronts the fourth surface wall 502 and which has a plurality of annular engaging plugs 61 extending upwardly in the longitudinal direction from the fifth surface wall 502. Each engaging plug 61 is formed with a distal engaging portion 612, and a proximate engaging portion 613 proximate to the fifth wall surface 601 and provided with an inclined guiding portion 611. In addition, the engaging plug 61 is split to form a resilient portion 62 at a position opposite to the guiding portion 611. The resilient portion 62 has a radially and outwardly extending retaining portion 621 on a top end thereof so as to hook on the third surface wall 501 immediately after the engaging plug 61 has been press-fitted in the bore portion 512 of the respective mounting hole 51 against a biasing action of the retaining portion 621.

In assembly, after being sleeved retainingly on the engaging posts 44, the coupling members 45 are fitted snugly in the notch portions 513, respectively, by passing the shanks 452 thereinto after the peripheral flanges 452*a* have been brought to pass downwardly through the bore portion 512 to rest on the fourth surface wall 502 of the blade member 50. Subsequently, the engaging plugs 61 are brought to be inserted upwardly into and fitted snugly in the bore portions 512, respectively, so that the guiding portions 611 abut gradually against the constricted portions 511*a*.

As such, each engaging plug 61 can be inserted easily into the bore portion 512 of the respective mounting hole 51 due to the provision of the resilient portion 62. In addition, the engaging plug 61 and the coupling member 45 can be engaged together tightly, thereby preventing the creation of a clearance therebetween in the respective mounting hole 51. Thus, the blade member 50 can be retained securely on the mounting arm 40. Also, the noise due to vibrations when the ceiling fan rotates can be eliminated by virtue of the coupling members 45.

It is noted that the cap member 60 can be decorated to enhance the aesthetic appeal of the ceiling fan.

Figure 5:
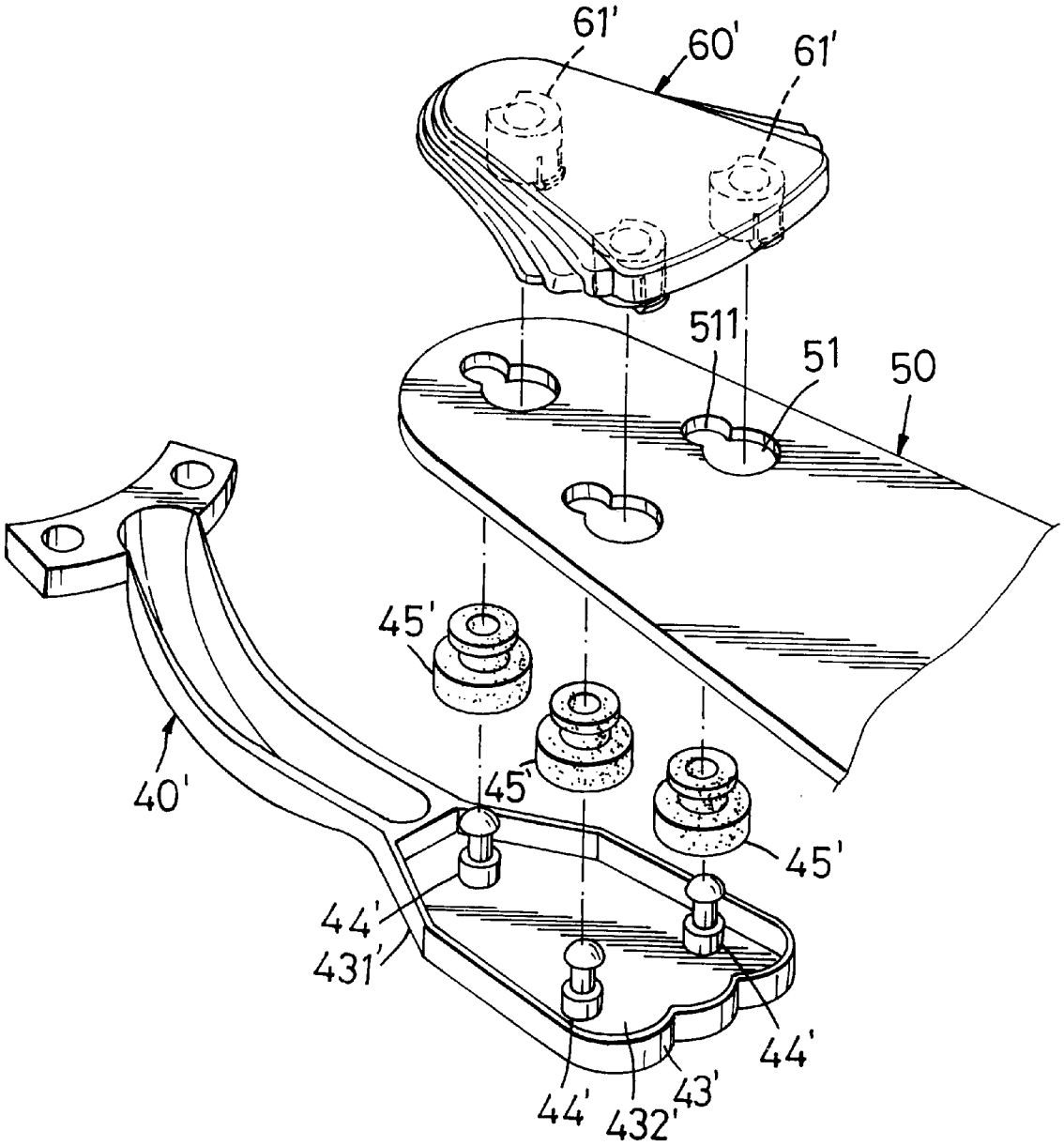
FIG. 5 is an exploded view of a second preferred embodiment of a portion of a fan blade assembly according to this invention.
Figure 6:
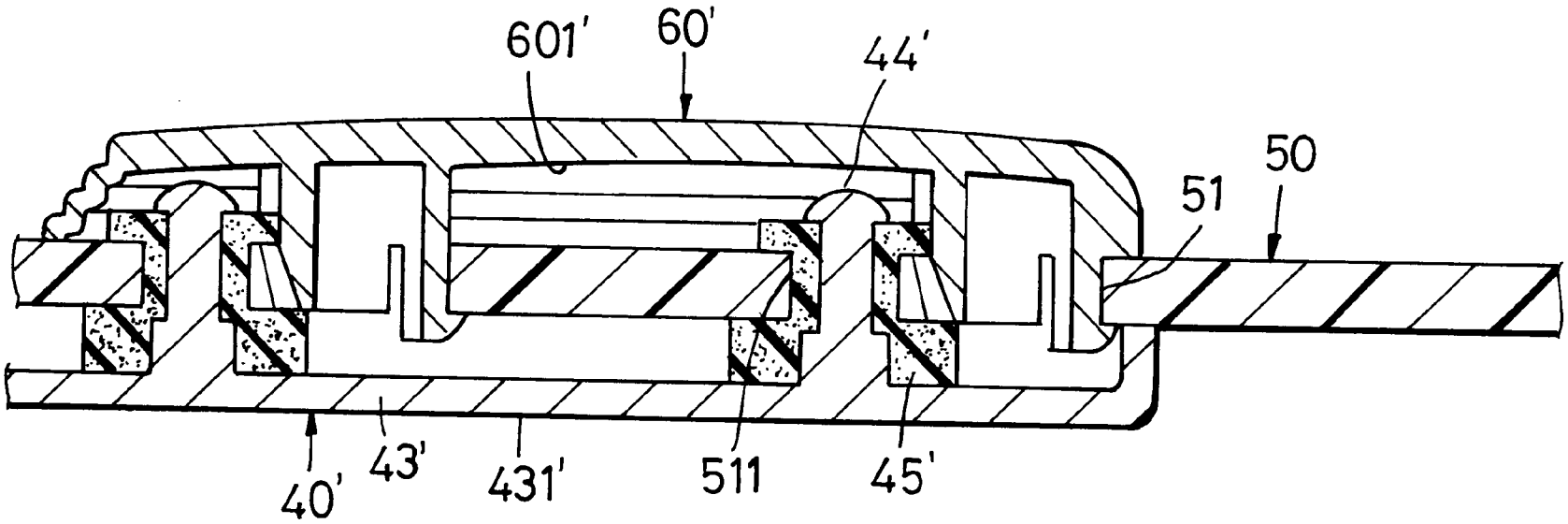
FIG. 6 is a sectional view of a portion of the fan blade assembly according to the second preferred embodiment.

Referring to FIGS. 5 and 6, the second preferred embodiment of the fan blade assembly according to this invention is shown to have a construction similar to that of the first preferred embodiment, except that the first surface wall 431' of the mounting arm 40' is under the second surface wall 432'. That is, the engaging posts 44' extend upwardly from the second surface wall 432'. Likewise, the engaging plugs 61' of the cap member 60' extend downwardly from the fifth surface wall 601' so as to retain the cap member 60' above the blade mounting end portion 43' in a manner similar to that mentioned hereinabove.

Figure 7:
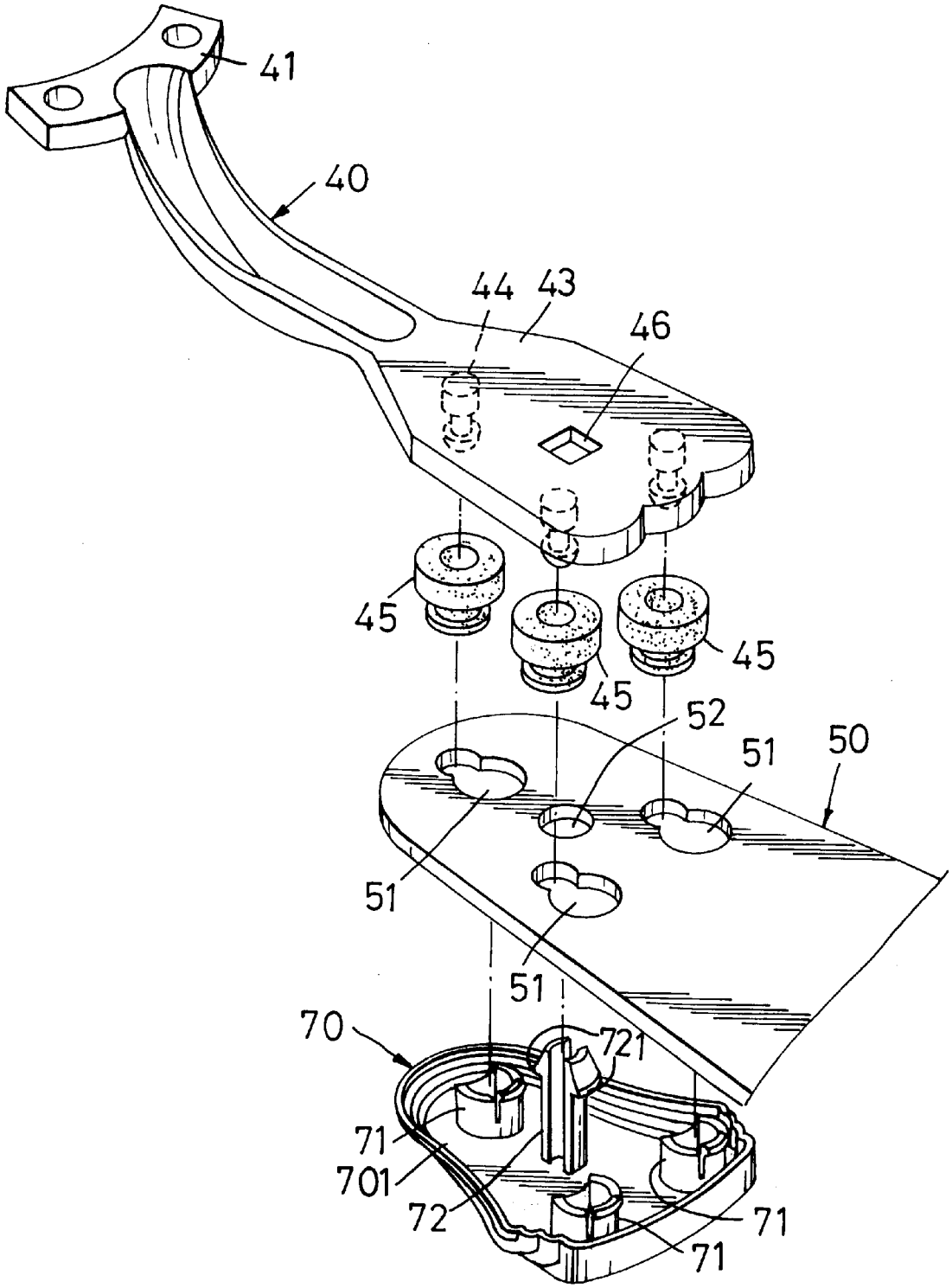
FIG. 7 is an exploded view of a third preferred embodiment of a portion of a fan blade assembly according to this invention.
Figure 8:
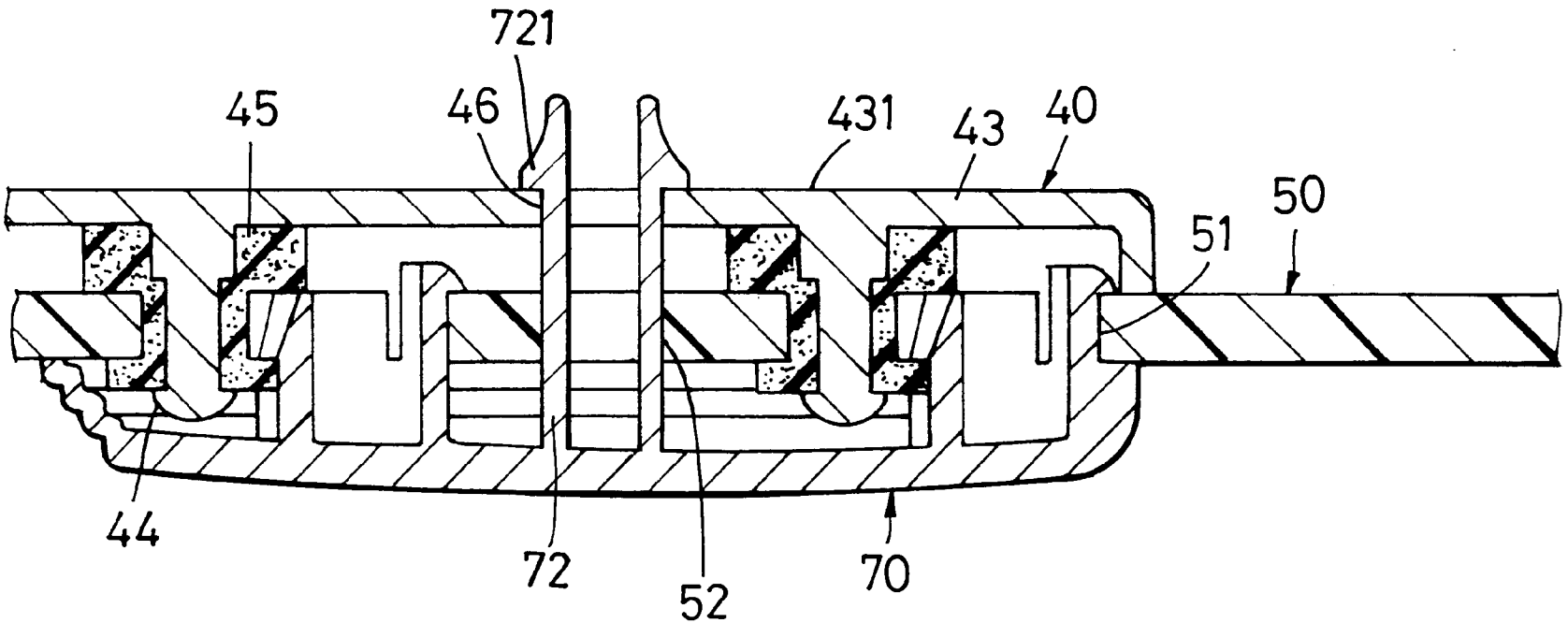
FIG. 8 is a sectional view of a portion of the fan blade assembly according to the third preferred embodiment.

FIGS. 7 and 8 show the third preferred embodiment of this invention, wherein, in addition to the components of the first preferred embodiment, the cap member 70 further has a resilient dog member 72 which extends upwardly in the longitudinal direction from the fifth surface wall 701 among the engaging plugs 71. The dog member 72 has a length longer than that of the engaging plugs 71, and a hook end portion 721 so as to hook on the first surface wall 431 immediately after the dog member 72 passes snugly though a through hole 52 in the blade member 50 and a through hole 46 in the blade mounting end portion 43 against a biasing action of the hook end portion 721. As such, the blade member 50 is firmly retained on the mounting arm 40.

Figure 9:
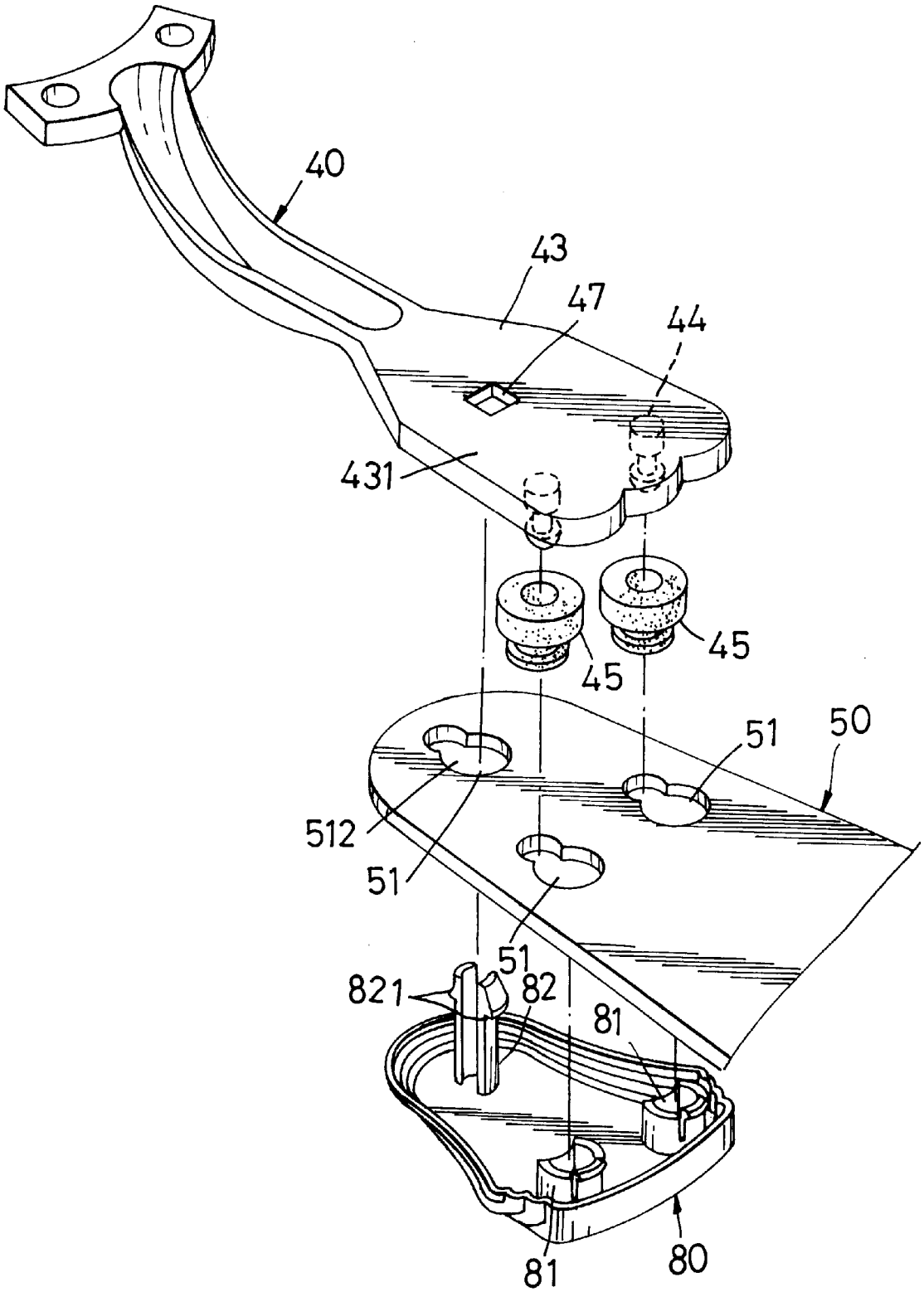
FIG. 9 is an exploded view of a fourth preferred embodiment of a portion of a fan blade assembly according to this invention.

Alternatively, as shown in FIG. 9, as compared with the first preferred embodiment, the cap member 80 of the fourth preferred embodiment has a dog member 82 to replace one of the engaging plugs 81. Since the dog member 82 is similar to the dog member 72 in FIG. 7, a detailed description of the construction thereof will be omitted herein. The blade mounting end portion 43 is formed with a through hole 47 near one of the engaging posts 44 so that the hook end portion 821 of the dog member 82 can pass through the bore portion 512 of one of the mounting holes 51 and the through hole 47 to hook on the first surface wall 431.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A fan blade assembly adapted to be mounted on a rotor of a ceiling fan, said fan blade assembly including a mounting arm having a plate-like blade mounting end portion with a first surface wall, a second surface wall, and a plurality of engaging posts protruding from said second surface wall in a longitudinal direction;

a blade member having a connecting end which has a third surface wall confronting said second surface wall and a fourth surface wall opposite to said third surface wall; and a cap member having a fifth surface wall confronting said fourth surface wall;

wherein the improvement comprises:

said connecting end further having a plurality of inner peripheral walls that confine respectively a plurality of mounting holes, each of said inner peripheral walls having a constricted portion to divide a corresponding one of said mounting holes into a notch portion and a bore portion of a dimension larger than that of said notch portion;

a plurality of elastomeric coupling members, each of which has a through hole formed therethrough such that a corresponding one of said engaging posts is inserted into and is retainingly engaged in said through hole, each of said coupling members including a shank, and a radial outward peripheral flange projecting from said shank, and being fitted snugly in said notch portion by passing said shank thereinto after said peripheral flange has been brought to pass through said bore portion to rest on said fourth surface wall of said blade member; and said cap member further having a plurality of annular engaging plugs, each of which extends in the longitudinal direction from said fifth surface wall to form a distal engaging portion and a proximate engaging portion proximate to said fifth surface wall, said distal engaging portion having a guiding portion at a position such that when said engaging plug is brought to be inserted into and fitted snugly in said bore portion of a respective one of said mounting holes, said guiding portion will abut gradually against said constricted portion.

2. The fan blade assembly as claimed in claim 1, wherein each of said engaging plugs is split to form a resilient portion with a radially and outwardly extending retaining portion which hooks on said third surface wall of said blade member immediately after each of said engaging plugs has been press-fitted in said bore portion of the respective one of said mounting holes against a biasing action of said retaining portion.

3. The fan blade assembly as claimed in claim 1, further comprising a resilient dog member formed on said cap member and extending in the longitudinal direction from said fifth surface wall, said dog member having a length longer than that of said engaging plugs, and a hook end portion which hooks on said first surface wall immediately after said dog member has been brought to pass snugly though said blade member and said blade mounting end portion against a biasing action of said hook end portion.

* * * * *